US006731897B2

(12) United States Patent
Nagano et al.

(10) Patent No.: US 6,731,897 B2
(45) Date of Patent: May 4, 2004

(54) POWDER OR TONER ACCOMMODATING CONTAINER

(75) Inventors: Kazuaki Nagano, Hachioji (JP); Masahiro Yoshino, Hachioji (JP); Tatsuo Nakanishi, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/367,168

(22) Filed: Feb. 14, 2003

(65) Prior Publication Data

US 2003/0156861 A1 Aug. 21, 2003

(30) Foreign Application Priority Data

Feb. 21, 2002 (JP) ..... 2002-044434

(51) Int. Cl.[7] ..... G03G 15/08
(52) U.S. Cl. ..... 399/262; 222/DIG. 1

(58) Field of Search ..... 222/DIG. 1, 167, 222/168, 169; 399/120, 258, 262, 263

(56) References Cited

U.S. PATENT DOCUMENTS 5,528,349 A * 6/1996 Satake ..... 399/262

* cited by examiner

*Primary Examiner*—Hoang Ngo
(74) *Attorney, Agent, or Firm*—Muserlian, Lucas and Mercanti

(57) ABSTRACT

This invention relates to a powder or toner accommodating container. This container is a powder or toner accommodating container having at least one engaging portion between a container main body and an accessory component to be mounted on the container main body, wherein the container includes a gas releasing function of releasing a gas in the container outside the container when a pressure difference between the interior and exterior of the container exceeds a predetermined value.

13 Claims, 7 Drawing Sheets

POWDER OR TONER ACCOMMODATING CONTAINER

BACKGROUND OF THE INVENTION

1. Field of the Invention

The present invention relates to a container for accommodating a powder and, more particularly, to a toner accommodating container which is used as it is loaded as a unit in an electrophotographic image forming apparatus such as a copying machine or printer.

2. Description of the Related Art

A method which allows the user to supply toner to an image forming apparatus such as an electrophotographic image forming apparatus includes a toner cartridge type with which a toner container is loaded as a unit in the image forming apparatus, and various other types with which a container is opened, and the toner in it is supplied to the apparatus. These toner accommodating containers are designed such that the toner will not contaminate the user's hands and the interior of the image forming apparatus when it is supplied by the user.

In recent years, a used toner container is collected, and the collected toner is filled with toner and is shipped and distributed again. A resin-made recyclable container which will not deform or break easily is becoming the mainstream. A resin-made container has a good size stability and sealing performance, so that the toner filled in it is less likely to spill from it.

As the accommodating container has a high airtightness, after it is filled with toner at the factory, it maintains the original atmospheric pressure and atmosphere under which the toner has been filled. Hence, the pressure in the container sometimes becomes higher than the external atmospheric pressure due to a temperature rise or the like. When such a container is opened, sometimes the toner in it spurts out due to the pressure difference, and the spurting toner powder contaminates the user or the apparatus. This problem annoys the user who exchanges the toner cartridge when the pressure in the container is high as in a hot summer day.

Among various types of powders and granular materials, some food powder such as a powder which is made from coffee beans or used to prepare instant soda water produces a gas while it is stored. Such a gas produced from the stored powder or granular material must be discharged outside the container. Otherwise, the interior of the container expands to break the container, thus impairing the commercial value as the commodity of the stored powder or granular material product itself.

In view of these problems, a method has been proposed with which an air permeable film or vent valve is attached to the container so that the internal pressure of the container is decreased. However, a cost increase accompanying addition of a new component and an increase in number of steps cannot be avoided.

When a means for not causing a pressure difference between the interior and exterior of the container is provided to the container, the accommodated powder product is set under such conditions that it is easily exposed to the influence of the outer atmosphere over a long period of time. This is not preferable in terms of keeping the quality of the product over a long period of time. For example, if the powder product is toner for electrophotography, it is adversely affected by the outer atmosphere and its charging performance changes undesirably. When a carriage accommodating such toner is loaded in the image forming apparatus, if the charging performance of the toner changes, a target image quality may not be obtained. When the powder product is food such as a juice powder, its quality may degrade by oxidation, and its taste may change undesirably.

Regarding a highly airtight resin-made container for accommodating a powder such as toner, a technique has not been established yet that solves the pressure difference occurring between the interior and exterior of the container while maintaining the quality of the product in the container over a long period of time, so that spurt of the powder upon opening the container is prevented.

SUMMARY OF THE INVENTION

The present invention has been made in order to solve the above problems, and has for its object to provide a powder accommodating container with which contamination by powder does not occur and a toner accommodating container with which toner contamination does not occur, in which when a pressure difference occurs between the interior and exterior of the container, an excessive gas in the container is released outside, so that the pressure difference between the interior and exterior of the container is solved gently, and spurt of the powder such as toner is prevented during opening the container.

It is another object of the present invention to provide an economical powder accommodating container and toner accommodating container with which even when a means for solving the pressure difference between the interior and exterior of the container is provided, the accommodated powder product maintains a target quality over a long period of time, and the number of components and the number of steps do not increase in the manufacturing process of the container.

In order to achieve the above objects, the inventors of the present invention conducted examinations repeatedly, and discovered that the above objects can be achieved by a technique according to any one aspect of the following arrangements.

First Aspect: a powder accommodating container having at least one engaging portion between a container main body and an accessory component to be mounted on the container main body, wherein the container comprises releasing means for releasing a gas in the container outside the container.

Second Aspect: a powder accommodating container according to the first aspect, wherein the releasing means is formed in the engaging portion.

Third Aspect: a toner accommodating container having at least one engaging portion between a container main body and an accessory component to be mounted on the container main body, wherein the container comprises releasing means for releasing a gas in the container outside the container.

Fourth Aspect: a toner accommodating container according to the third aspect, wherein the releasing means is formed in the engaging portion.

Fifth Aspect: a toner accommodating container according to the third and fourth aspects, wherein the releasing means releases the gas in the toner accommodating container outside the container when a pressure difference between an interior and exterior of the container exceeds a predetermined value.

Sixth Aspect: a toner accommodating container according to the fifth aspect, wherein the releasing means releases the gas in the toner accommodating container outside the container when the pressure difference between the interior and exterior thereof exceeds 3.5 kPa.

Seventh Aspect: a toner accommodating container according to the third to sixth aspects, wherein the releasing means is a gas releasing groove formed by providing a surface of a member that constitutes the toner accommodating container with a plural and continued fine notches.

Eighth Aspect: a toner accommodating container according to the seventh aspect, wherein a width or depth of each of the notches that constitutes the gas releasing groove is larger than a particle size of toner particles to be accommodated in the toner accommodating container.

Ninth Aspect: a toner accommodating container according to the eighth aspect, wherein a depth of each of the notches that constitutes the gas releasing groove is in a range of 15 $\mu$m to 100 $\mu$m (both inclusive).

According to the present invention, in a powder or toner accommodating container placed in an atmosphere, e.g., in a high temperature, where a pressure difference occurs between an interior and exterior of the container, a gas releasing means is provided for releasing an excessive gas in the container outside gently and gradually when the pressure difference between the interior and exterior of the container exceeds a predetermined value. Thus, the pressure difference between the interior and exterior of the container is eliminated gently, so that powder spurt upon opening the container can be prevented. This enables to provide a powder accommodating container which does not cause contamination by the powder and a toner accommodating container which does not cause contamination with the toner.

The gas is released through the gas releasing means only when the pressure difference between the interior and exterior of the container exceeds the predetermined value, so that the air-tightness in the container is held. This enables to provide a powder accommodating container and toner accommodating container with which a powder product accommodated in it can maintain a desired quality over a long period of time.

When an improved molding die is used, a gas releasing means for eliminating the pressure difference between the interior and exterior of the container is provided. This enables to provide an economical powder accommodating container and toner accommodating container which do not increase the number of components or the number of steps in the manufacturing process of the container.

The above and many other objects, features and advantages of the present invention will become manifest to those skilled in the art upon making reference to the following detailed description and accompanying drawings in which a preferred embodiment incorporating the principle of the present invention is shown by way of illustrative examples.

BRIEF DESCRIPTION OF THE DRAWINGS

FIGS. 5A to 5C are schematic views, respectively, for explaining gas releasing means provided to the toner replenishing port, in which FIG. 5A is a partially expanded sectional view of the toner replenishing port, and FIGS. 5B and 5C are partial plan views seen from directions B—B and C—C in FIG. 5A, respectively;

DETAILED DESCRIPTION OF THE PREFERRED EMBODIMENT

Figure 1:
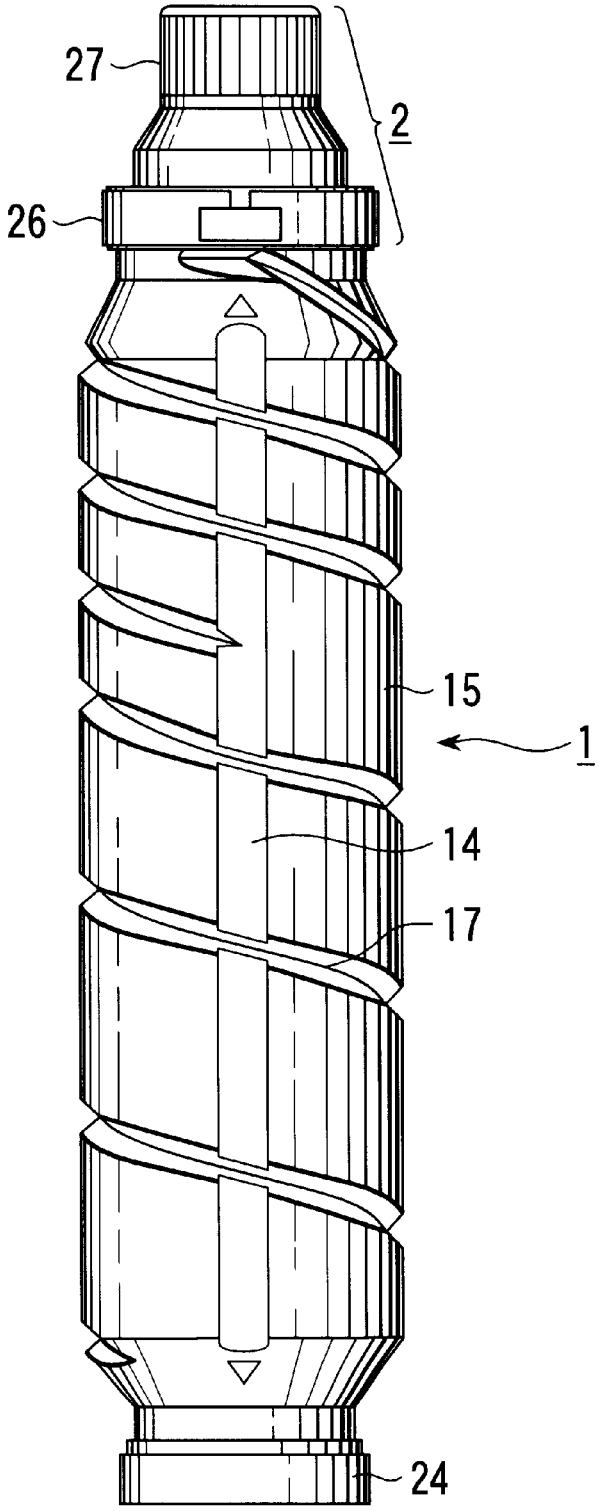
FIG. 1 is an outer appearance view of a toner accommodating container to which a cap for a toner replenishing port is attached.

The present invention provides a powder accommodating container and toner accommodating container having at least one engaging portion between a container main body and an accessory component to be mounted on the container main body, in which a gas releasing means for releasing a gas in the container outside the container when a pressure difference equal to or more than a predetermined value occurs between the interior and exterior of the container is provided. When the pressure in the container is higher than that outside the container, the excessive gas in the container is gently and, gradually released outside the container, so that any pressure difference between the interior and exterior of the container is prevented, and a powder such as toner will not spurt to contaminate when the container is opened.

The present invention also prevents, with the above arrangement, any durability decrease of the container occurring when an releasing means is added, and enables to provide an economical container which is free from a cost increase and a container which is free from quality degradation.

In the powder accommodating container or toner accommodating container according to the present invention, the gas is released through the gas releasing means only when the pressure difference between the interior and exterior of the container exceeds the predetermined value, so that the airtightness in the container is held. This promotes to maintain the quality of the powder product stored in the container over a long period of time. More specifically, with the container according to the present invention, when the powder to accommodate is toner, the airtightness in the container is maintained when the pressure difference between the interior and exterior of the container is up to 3.5 kPa (about 400 mmAq). The excessive gas in the container is released outside the container only when the pressure difference exceeds this value. With the container according to the present invention, the value of the pressure difference between the interior and exterior of the container when the gas releasing means is activated is not limited to 3.5 kPa described above. That is, the value of the pressure difference is arbitrarily set in accordance with the kind and amount or characteristics of the powder or granular material to be accommodated in the container. The value of the pressure difference can also be arbitrarily set in accordance with the kind, physical properties, and durability of the material that constitutes the container. Accordingly, even when the present invention is aimed at a toner container, if the toner container is fabricated using a material that does not satisfy the performance assumed by the present invention due to an acceptable reason, the container may release an extra gas in the container before the pressure difference between the interior and exterior of the container reaches 3.5 kPa.

As a practical example of the gas releasing means to be formed in the powder accommodating container or toner accommodating container according to the present invention, a small gas releasing groove may be formed in the surface of a member that constitutes the container. In the container according to the present invention, the gas releasing groove is formed in the surface of the member. Even when the gas releasing means is added to the container, it does not increase the number of components or the number of steps. More specifically, only a design change of forming a gas releasing groove in a resin molding die for manufacturing a container is performed. When compared to a container to which a component is added by employing an air permeable seal-like member or vent valve member, the container according to the present invention is apparently excellent in terms of productivity and cost.

According to the present invention, the gas flow between the interior and exterior of the container can be controlled by controlling the size of the gas releasing groove formed in the surface of the member. More specifically, the researchers of the present invention conducted extensive experiments and studies repeatedly, and reached a conclusion that when the depth of the gas releasing groove formed in the surface of the member was equal to 15 $\mu$m or less, the internal pressure of the container did not decrease, that is, the excessive gas in the container was not released, and when the depth of the gas releasing groove exceeded 15 $\mu$m, the internal pressure of the container decreased, and the gas in the container could be released. Meanwhile, when the depth of the gas releasing groove exceeded 100 $\mu$m, the pressure in the container did not increase.

It was confirmed that the length of the gas releasing groove formed in the container also adversely affected the gas releasing performance. With the toner accommodating container, when the length of the gas releasing groove formed in the engaging portion was about 3 mm, the air-tightness in the container was reliably held until the pressure difference reached a predetermined value. When the pressure difference exceeded the predetermined value, the gas was released gradually.

The shape of the gas releasing groove was also studied. When the gas releasing groove had a U-shaped, V-shaped, or semicircular section, the gas was released as far as the depth of the gas releasing groove was 15 $\mu$m or more, but the gas releasing speed differed.

In this manner, according to the result of the studies conducted by the inventors of the present invention, when the conditions of the gas releasing groove of the powder accommodating container according to the present invention, e.g., depth, width, shape, and length, the values of which may vary, were controlled, the action of the present invention was reproduced more effectively.

When the powder was toner, as far as the depth of the formed gas releasing groove fell within the range of 15 $\mu$m to 100 $\mu$m, when a pressure difference exceeding the predetermined value occurred between the interior and exterior of the container, an excessive gas in the container was released outside. According to the result of further studies conducted by the inventors of the present invention, when the powder was toner particles, the preferable depth was 15 $\mu$m to 60 $\mu$m, and more preferably 20 $\mu$m to 45 $\mu$m.

The depth and the like of the gas releasing groove can be confirmed by measuring steps on the surface of the member with a probe contact type surface roughness measurement unit or from a microscopic photograph if the particle size is as small as on the order of $\mu$m like that of the toner. Various types of confirming means are used depending on the particle size. For example, when the particle size is large, a loupe or the like may be used.

Figure 5A:
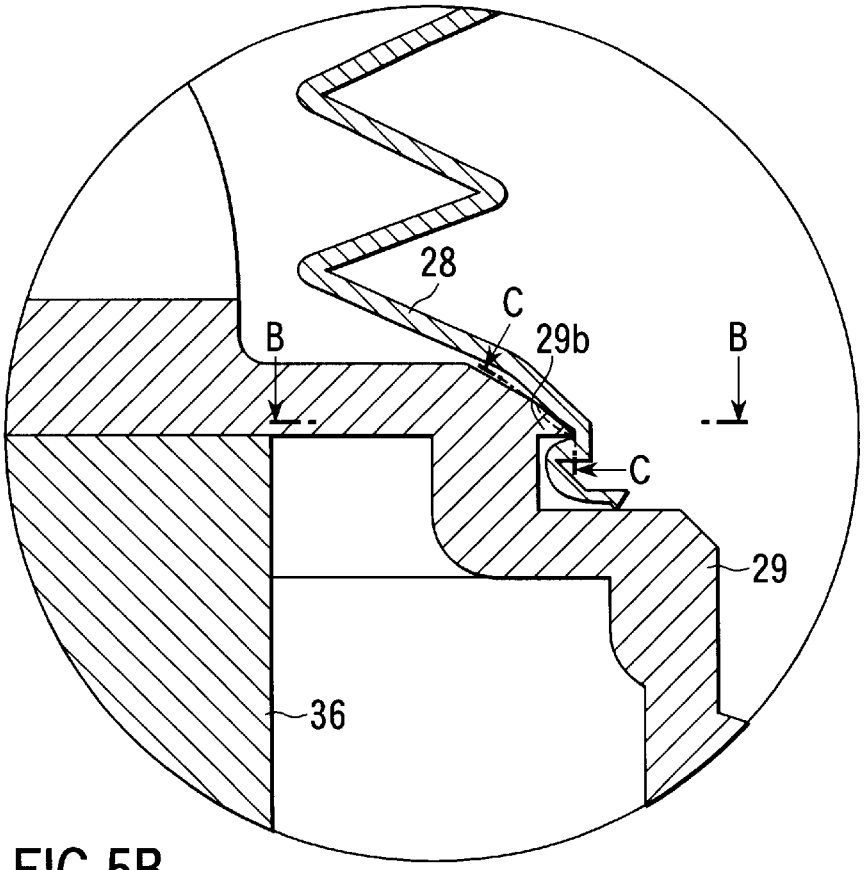
Figure 5B:
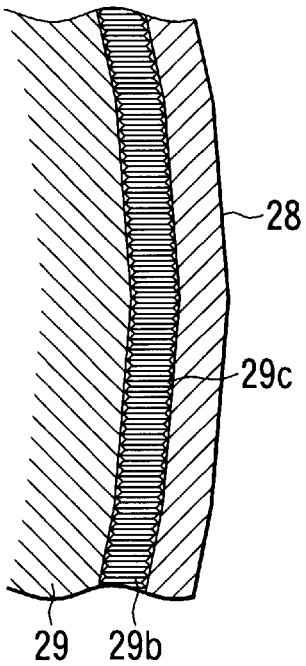
Figure 5C:
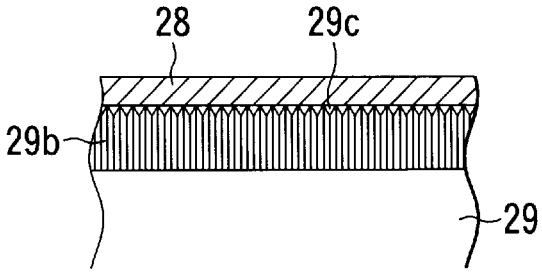

FIGS. 5A to 5C are schematic views showing examples of a gas releasing groove added to the container according to the present invention. Although a large number of gas releasing grooves as the gas releasing means are formed in FIGS. 5A to 5C, the number of gas releasing grooves is not particularly limited in the present invention, and is arbitrary as far as the gas releasing grooves release the gas in the container when the pressure difference exceeds the predetermined value.

As is apparent from the above description, while the particle size of the toner particles to be stored in the container is several $\mu$m to ten-odd $\mu$m, the gas releasing groove added to the container was larger than the toner particles. With the container according to the present invention, the toner particles did not spill from the gas releasing groove. The reason for this is not clear, but may be as follows. Probably, the powder particles support each other like a bridge to agglomerate, so that they did not spill from the gas releasing groove larger than the particle size. Also, it is estimated that the gas in the container was released outside the container through small gaps among the particles that formed the bridge.

In this manner, with the container according to the present invention, the powder did not spill from the groove, while only the gas was reliably released outside. The excessive gas in the container may be released outside the container through a filter formed by the powder particles that agglomerated like a bridge.

According to the present invention, concerning the container for storing the toner, when the depth of the gas releasing groove was set within the range described above, the excessive gas in the container was reliably released, but the value of the depth of the gas releasing groove is not limited to this range. The width, depth, and shape of the gas releasing groove are set in accordance with the kind, shape, size, or characteristics of the powder to be stored, as described above.

The present invention does not particularly limit where to form the gas releasing means in the container, but the gas releasing means is preferably formed at that portion of the container constituting member which is rigid, does not deform easily, and is durable, and at which the interior and the outside of the container are comparatively close to each other. For example, a gas releasing groove may be formed by forming steps on one side of the constituting member which forms an engaging portion between the container main body and a powder replenishing port. In FIGS. 5A to 5C, as an example of a portion to form the gas releasing means in the toner accommodating container according to the present invention, the gas releasing means is formed at the lower end of a toner discharging member 29, as will be described above, but the portion to form the gas releasing means is not limited to this. Other than the portion described above, the gas releasing means can be formed at an engaging portion of a container main body 15 and fitting lid 26, or at an engaging portion of the container main body 15 and a rear cap 24 which is on the opposite side to the toner replenishing port, as far as the toner accommodating container is the one shown in FIG. 2 and the like.

The gas releasing means to be formed in the container according to the present invention is not limited to the groove described above, but can be of any type as far as it allows the gas to move between the interior and exterior of the container when the container storing powder is covered with a lid or is plugged tightly. More specifically, other than the gas releasing groove described above, the gas releasing groove may form nonlinear continuous gaps like satin gaps, interstices, or tunnel-like bored holes. Also, the gas releasing groove is not limited to a linear one.

Embodiment

A container according to the present invention will be described hereinafter in the embodiment by way of a toner container with reference to the accompanying drawings. Note that the present invention is not limited to this embodiment.

Figure 2:
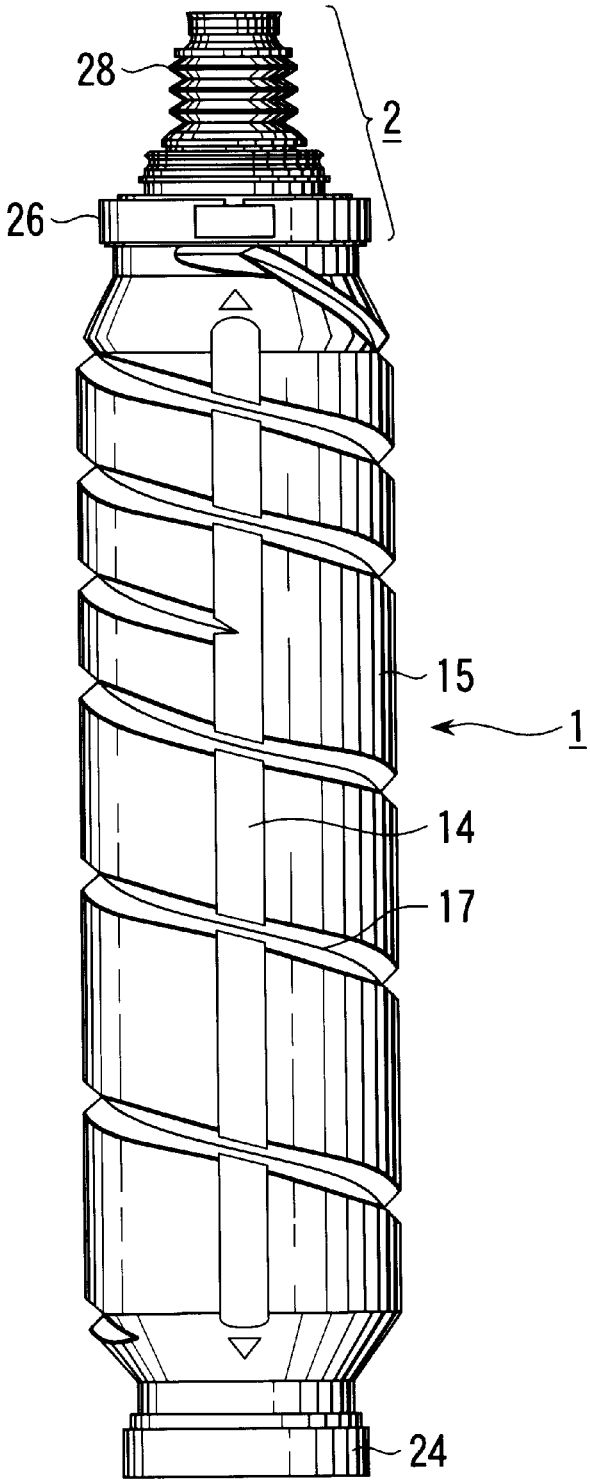
FIG. 2 is an outer appearance view of the toner accommodating container from which the cap for the toner replenishing port is removed.

FIG. 1 is an outer appearance view of a cylindrical toner accommodating container 1 according to the present invention, and shows a shape when a cap 27 for a toner replenishing port 2 is attached to it. FIG. 2 is an outer appearance view showing a shape when the cap 27 is removed from the toner replenishing port 2.

The cylindrical toner accommodating container 1 is comprised of the container main body 15 and the toner replenishing port 2 which engages with one side end of the container main body 15. The container main body 15 has a helical groove 17 which has a projection and recess on the inner and outer surfaces, respectively, of its cylindrical shape, and axial pitches that narrow toward the toner discharging port. Two linear grooves 14 intersecting the helical groove 17 are formed in the outer surface of the cylindrical toner accommodating container 1 perpendicularly (in the axial direction of the cylinder) to the outer circumference and between the upper and lower portions of the cylindrical toner accommodating container 1. The rear portion of the cylindrical container main body 15 is closed by the rear cap 24.

FIGS. 3A to 3D are outer appearance views of the toner replenishing port 2 of the toner accommodating container 1. As shown in FIGS. 1 and 2, the toner replenishing port 2 is arranged at the distal end of the container main body 15 of the toner accommodating container 1, and is comprised of the fitting lid 26 which directly engages with the container main body 15 of the toner accommodating container 1, the cap 27, a bellows inner lid 28, the toner discharging member 29, and the like.

Figure 3A:
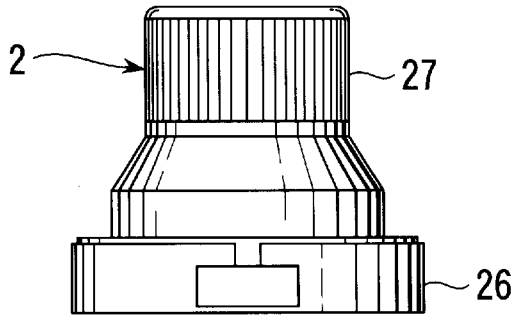
FIGS. 3A to 3D are outer appearance views of the toner replenishing port.
Figure 3B:
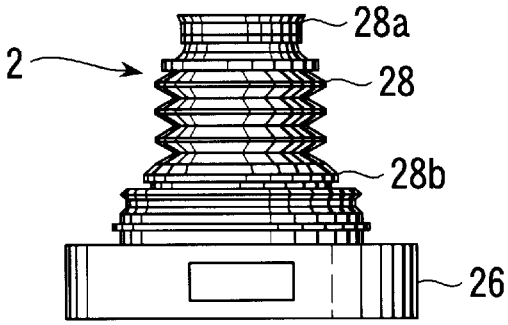
Figure 3C:
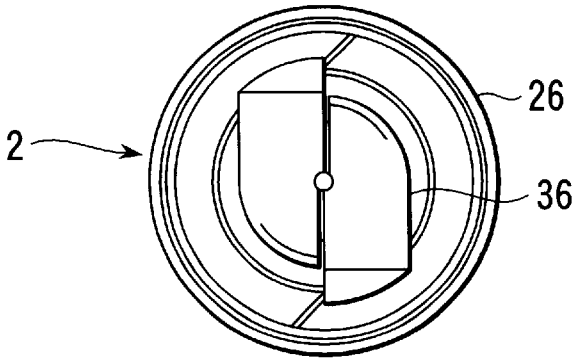
Figure 3D:
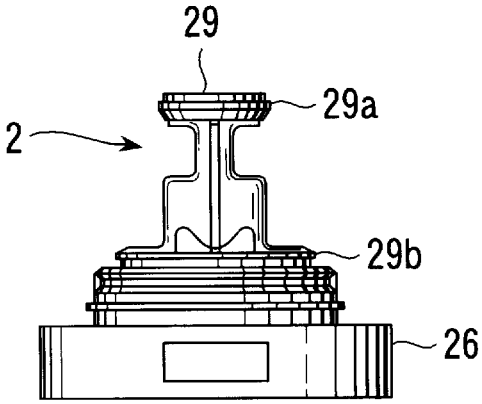

FIG. 3A is a front view of the toner replenishing port 2, FIG. 3B is a front view showing a state wherein the cap 27 for the toner replenishing port 2 is removed, FIG. 3C is a view of the toner replenishing port 2 seen from below, and FIG. 3D is a front view of the fitting lid 26, which is equivalent to FIG. 3B but with the bellows inner lid 28 removed. As is apparent from FIGS. 3A to 3D, the toner replenishing port 2 is comprised of the cap 27, the bellows inner lid 28, and the fitting lid 26 which directly engages with the toner accommodating container 1. As shown in FIG. 3C, the fitting lid 26 incorporates a scraping member 36.

When the cap 27 is removed from the toner replenishing port 2, the bellows inner lid 28 is revealed as shown in FIG. 3B. When the cap 27 is removed, an end 28*a* of the bellows inner lid 28 forms a contact state with an upper end 29*a* of the toner discharging member 29 shown in FIG. 3D. The other end 28*b* of the bellows inner lid 28 engages with a lower end 29*b* of the toner discharging member 29 shown in FIG. 3D.

Figure 4B:
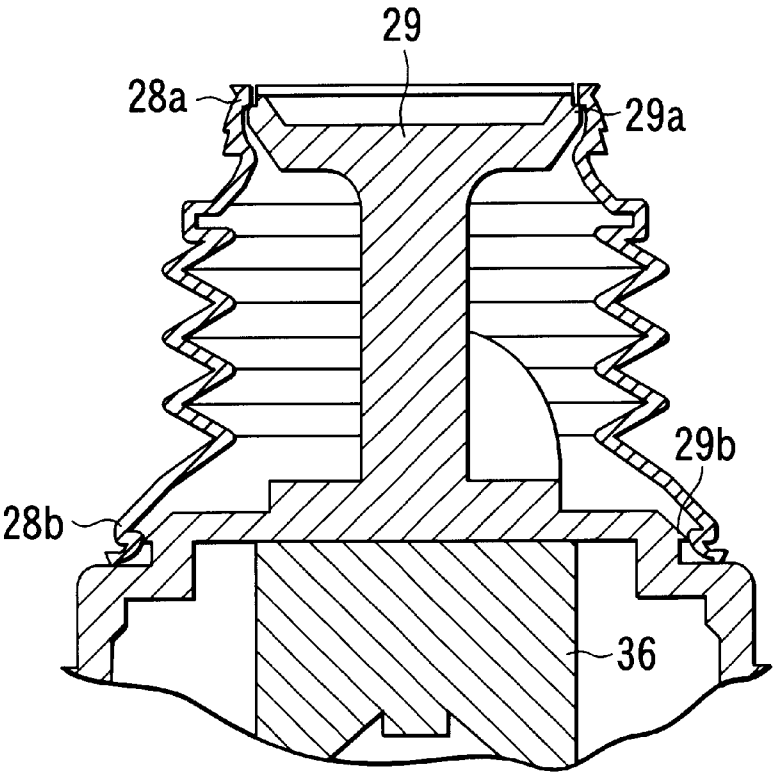
FIGS. 4A and 4B are sectional views showing the toner replenishing port on which the cap is mounted and from which the cap is removed, respectively.
Figure 4A:
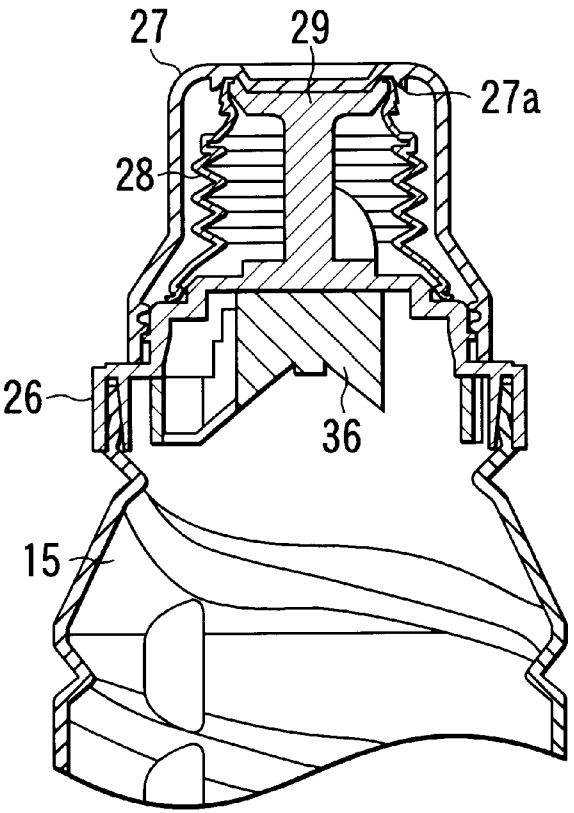

FIGS. 4A and 4B are sectional views respectively showing states wherein the cap 27 is mounted on and removed from the toner replenishing port 2 of the toner accommodating container 1 according to the present invention.

As shown in FIG. 4A, when the cap 27 is mounted on the toner replenishing port 2, the cap 27 presses the bellows inner lid 28 of the toner replenishing port 2. At this time, the circumferential end 28*a* of the bellows inner lid 28 near the opening is pressed by an annular projection 27*a* formed on the lower surface of the cap 27. Thus, the inner surface of the circumferential end 28*a* and the outer surface of the upper cylindrical end 29*a* of the toner discharging member 29 come into tight contact with each other to form an airtight state.

As shown in FIG. 4B, when the cap 27 is removed, the inner surface of the circumferential end 28*a* of the bellows inner lid 28 and the outer surface of the upper cylindrical end 29*a* of the toner discharging member 29 maintain the contact state. However, as the bellows inner lid 28 pressed by the cap 27 is released, this contact state is not strong. As is apparent from FIGS. 4A and 4B, the inner surface of the lower end 28*b* of the bellows inner lid 28 always forms a contact state with the outer surface of the lower end 29*b* of the toner discharging member 29.

FIGS. 5A to 5C are schematic views, respectively, of a gas releasing means formed on the toner replenishing port 2 of the toner accommodating container 1 according to the present invention.

As shown in FIG. 5A, the toner accommodating container 1 according to the present invention has a thin gas releasing groove 29*c* serving as a gas releasing means in the lower end 29*b* of the toner discharging member 29. The gas releasing groove 29*c* is formed by providing the surface of the lower end 29*b* with a plural and continued fine notches as shown in FIGS. 5B and 5C. When the gas releasing groove 29*c* is arranged in the lower end 29*b*, even when the toner accommodating container 1 according to the present invention is left in a high-temperature atmosphere or the like where a pressure difference occurs between the interior and exterior of the container, toner spurt does not occur. When the cap 27 is mounted, the toner will not attach to the inner side of the cap 27, unlike in the conventional toner cartridge. The toner will not spurt from the gap between the end 28*a* of the bellows inner lid 28 and the upper end 29*a* of the toner discharging member 29 at the moment the cap 27 is removed, to contaminate the body of the user and the apparatus.

As described above, according to the present invention, when the pressure difference between the interior and the outside of the container is up to 3.5 kPa, the excessive gas in the container is not discharged through the gas releasing groove 29*c*. In the toner accommodating container 1 shown in FIGS. 1 and 2, the toner does not spurt from the gap between the end 28*a* of the bellows inner lid 28 and the upper end 29*a* of the toner discharging member 29 unless the pressure difference exceeds 3.5 kPa.

As described above, with the container according to the present invention, the atmosphere in the container is maintained until the predetermined pressure by adjusting the depth of the gas releasing groove.

With the container according to the present invention, the quality of the powder product accommodated in the container which has released the gas is maintained stably after gas release. The inventors of the present invention confirmed that the charging performance and the image quality of the toner accommodated in the toner accommodating container 1 which had released the gas did not change. More specifically, an experiment was conducted in which after the toner accommodating container 1 that had released the gas was stored in stock for a long period of time in a high-temperature, high-humidity atmosphere of 30° C. and 80%RH, the charging performance of the accommodated toner was measured, and the toner accommodating container 1 was loaded in a copying machine to form a copy image. As a result, the charging performance did not change, and a good copy image was obtained.

In this manner, with the container according to the present invention, the powder product accommodated in the container which had released the gas was not easily affected by the external humidity or the like. The reason a certain degree of sealing performance in the container is maintained even after gas release is not clear, but may be as follows. The gas releasing means provided to the container according to the present invention exhibits its permeability with only a certain degree of pressure difference, so that it is actuated only when the pressure difference between the interior and exterior of the container exceeds the predetermined value.

Figure 6:
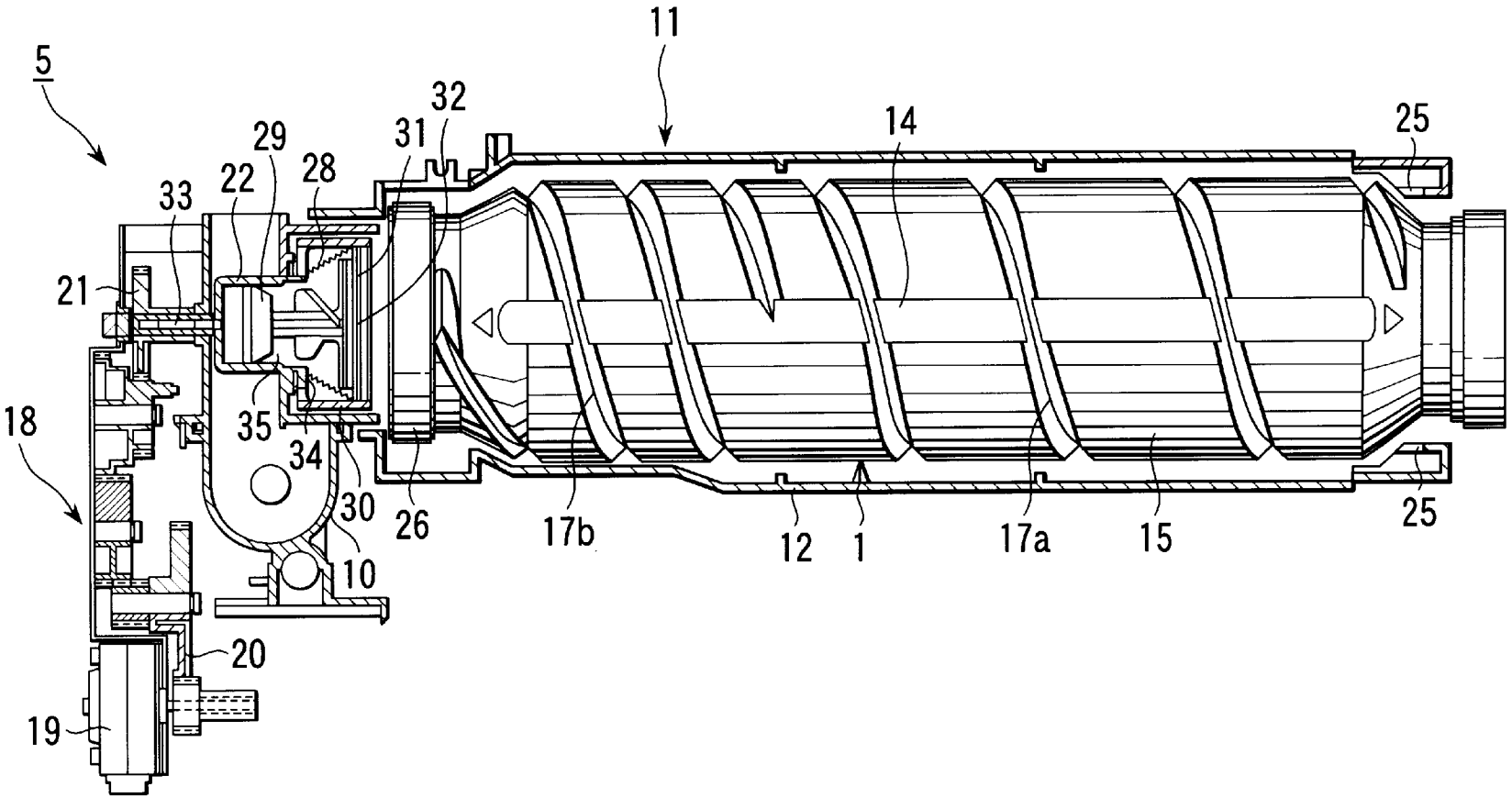
FIG. 6 is a sectional view of a toner replenishing apparatus on which the toner accommodating container is loaded.

FIG. 6 is a sectional view of a toner replenishing apparatus to which the toner accommodating container 1 preferably used by the present invention is loaded.

As described above, in the toner accommodating container 1, the toner replenishing port 2 engages with one end of the cylindrical container main body 15. The container main body 15 has a helical groove 17*a* which has a projection and recess on the inner and outer surfaces, respectively, of its cylindrical shape, and axial pitches that narrow toward the toner discharging port. The helical groove 17*a* is formed in the outer surface of the container main body 15 by one round or more. Another helical groove 17*b* is formed in that portion of the outer surface of the container main body 15 which is the closest to the toner replenishing port 2. Hence, a total of two helical grooves are formed.

During toner replenishment to a developing device (to be described later), a rotation transmitting member (to be described later) applies rotational movement to the toner accommodating container 1 according to the present invention about the center axis of the cylindrical shape. As the toner accommodating container 1 rotates, the helical grooves 17*a* and 17*b* serve as ribs that convey the toner toward a toner discharging port 35 at the distal end of the toner replenishing port 2.

Since the helical grooves 17*a* and 17*b* are formed with pitches that narrow toward the toner replenishing port 2, the toner conveying performance improves greatly. Even when the toner remaining amount in the toner accommodating container 1 becomes small, the toner can be smoothly supplied to the developing unit. In particular, since two or more helical grooves are formed, toner supply from the toner accommodating container 1 to the developing unit is promoted greatly.

The two linear grooves 14 intersecting the helical groove 17 are formed in the outer surface of the cylindrical toner accommodating container 1 according to the present invention perpendicularly (in the axial direction of the cylinder) to the outer circumference and at a predetermined distance from each other. Two projections 25 respectively corresponding to the two linear grooves are formed at the inlet of the inner surface of a toner accommodating container holding member 12 to which the toner accommodating container 1 is to be inserted.

The cylindrical toner accommodating container 1 is inserted in the similarly cylindrical toner accommodating container holding member 12 while causing the two linear grooves and the two projections 25 formed at the inlet of the inner surface of the cylindrical toner accommodating container holding member 12 to coincide with each other at positions on the joint circumference. Therefore, the toner accommodating container 1 and toner accommodating container holding member 12 can be aligned easily.

The positions or shapes of the two grooves 14 formed in the toner accommodating container 1 differ depending on the color and kind of toner to be stored in the toner accommodating container 1. The positions or shapes of the projections 25 formed on the inlet of the inner surface of the toner accommodating container holding member 12 also differ depending on the color and kind of toner to be used by the developing unit 5. Accordingly, the toner accommodating container 1 can be inserted in the toner accommodating container holding member 12 only when the toner to be used by the developing unit 5 and the toner stored in the toner accommodating container 1 coincide with each other.

When the toner to be used by the developing unit 5 and the toner stored in the toner accommodating container 1 do not coincide with each other, the positions and shapes of the two linear grooves and two projections 25 do not coincide. Thus, erroneous insertion of the toner accommodating container 1 into the toner accommodating container holding member 12 is prevented, and erroneous setting of the toner accommodating container 1 is prevented.

A toner replenishing unit 11 according to the present invention is constituted as part of the developing unit 5, and is formed of the cylindrical toner accommodating container 1, the cylindrical toner accommodating container holding member 12, a rotation transmitting member 18 for rotating the toner accommodating container 1, and the like.

The rotation transmitting member 18 is comprised of a motor 19, a gear group 20 rotatably driven by the motor 19, a final gear 21 of the gear group 20, a junction holder 22 having a rotating shaft 33 engaging with the final gear 21, and the like. After the cap 27 is removed from the toner accommodating container 1, the toner accommodating container 1 is inserted in the toner accommodating container holding member 12, and is connected to the junction holder 22 through the toner replenishing port 2 of the toner accommodating container 1. When the junction holder 22 is rotatably driven, the toner accommodating container 1 rotates. This rotation is caused when the toner amount or toner density in a developing device 10 becomes insufficient. When the toner accommodating container 1 rotates, the toner in the toner accommodating container 1 is supplied to the developing device 10 through the toner discharging port 35 at the projecting end of the toner accommodating container 1.

More specifically, the junction holder 22 is comprised of the rotating shaft 33 engaging with the final gear 21, a bellows inner lid opening/closing pawl 34, and the like, in addition to an engaging pawl which engages with the toner replenishing port 2. When the toner discharging member 29 as the projecting end of the toner accommodating container 1 is inserted in the junction holder 22, the bellows inner lid opening/closing pawl 34 slides the bellows inner lid 28 toward the main body of the toner accommodating container 1, to move it to the open position, so that the toner discharging port 35 is opened. Hence, the toner accommodating container 1 communicates with the developing device 10 through the toner discharging port 35, thus ending attaching operation of the toner accommodating container 1.

In this manner, when the toner accommodating container 1 is to be attached in the plain paper copying machine, the bellows inner lid 28 need not be opened in advance, but only the cap of the toner replenishing port 2 of the toner accommodating container 1 need be removed in advance. Therefore, spill of the toner from the toner discharging port 35 is prevented, and the hands and clothes of the operator are prevented from being contaminated by the spilled toner. When the toner accommodating container 1 is to be extracted from the toner accommodating container holding member 12, the bellows inner lid 28 returns to the initial closed state. Hence, the toner discharging port 35 is covered by the bellows inner lid 28, so that spill of the toner attaching to the projecting end of the toner accommodating container 1 is prevented, and the hands and clothes of the operator are prevented from being contaminated by the spilled toner.

The scraping member 36 shown in FIG. 3C will be described. The scraping member 36 is formed of two intersecting slopes. The conveyed toner is scraped up from the distal ends of the scraping portions connected to the helical grooves 17*a* and 17*b* and moves to the toner discharging port 35 while sliding down the slopes, so that it is finally supplied to the developing device 10 from the toner discharging port 35. In this manner, the scraping member 36 guides the toner to the toner discharging port 35 in order that the toner is conveyed and discharged from inside the toner accommodating container 1 through the toner discharging port 35 formed at one side end of the toner accommodating container 1 in the vicinity of the container rotating shaft.

As the toner accommodating container 1 rotates, the scraping member 36 scrapes up the toner that has moved toward the toner discharging port 35, and sends the toner that has been put on the scraping member 36 to the toner discharging port 35. The distal end of the scraping member 36 is arranged at a position corresponding to the projections of the helical grooves 17*a* and 17*b*. Scraping mechanism portions corresponding in number to the number of ridges of the helical grooves 17*a* and 17*b* are arranged in the toner accommodating container 1.

Figure 7:
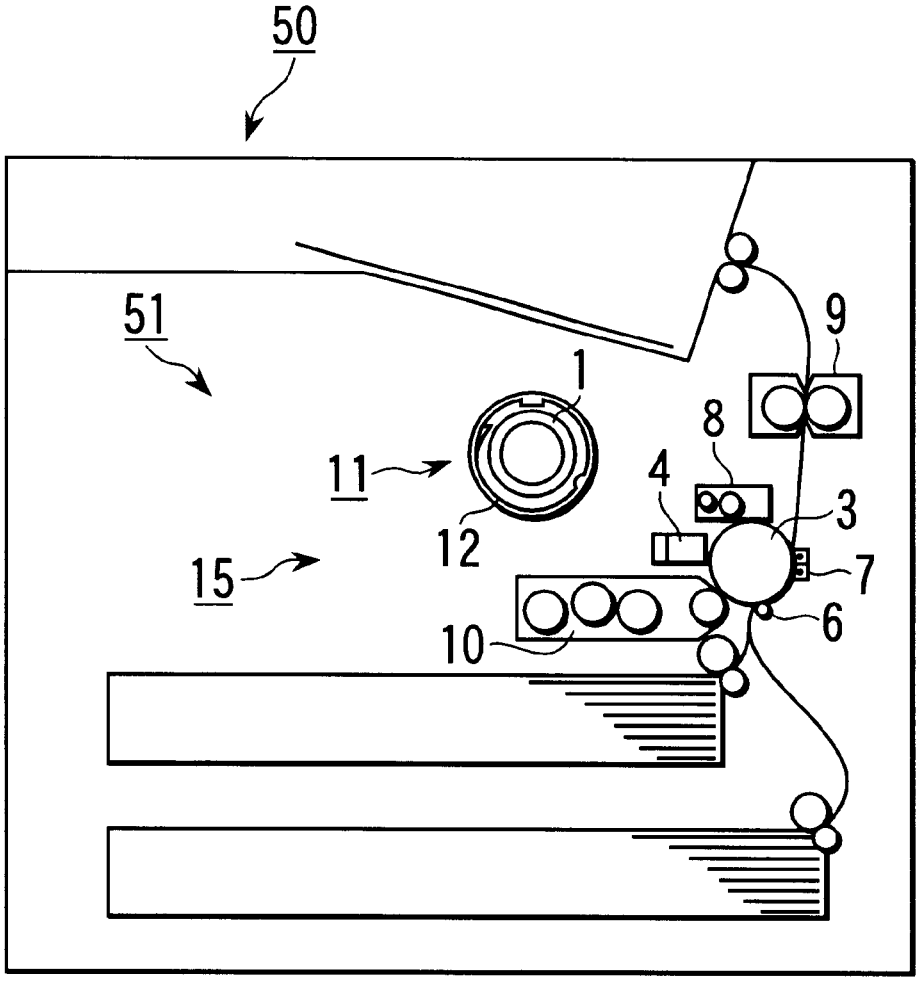
FIG. 7 is a schematic view showing an example of an image forming apparatus in which the toner accommodating container is mounted.

FIG. 7 is a front view showing the simplified overall structure of a plain paper copying machine 50 as an image forming apparatus to which the toner accommodating container 1 preferably used in the present invention is mounted. A drum-like photosensitive body 3 is formed at substantially the center in a main body case 51 of the plain paper copying machine 50. A charging/exposure unit 4, the developing unit 5, a transfer device 6, a separation device 7, a cleaning unit 8, and the like are arranged around the photosensitive body 3, and a fixing unit 9 is arranged above the photosensitive body 3. The developing unit 5 is comprised of the developing device 10 and toner replenishing unit 11.

As described above, the toner replenishing unit 11 has the toner accommodating container holding member 12 which holds the toner accommodating container 1 substantially horizontally and rotatably. Although not shown, the toner accommodating container holding member 12 is attached to the main body of the image forming apparatus substantially horizontally.

What is claimed is:

1. A powder accommodating container having at least one engaging portion between a container main body and an accessory component to be mounted on the container main body, wherein the container comprises releasing means for releasing a gas in the container to outside the container, said releasing means being formed in said engaging portion.

2. A toner accommodating container having at least one engaging portion between a container main body and an accessory component to be mounted on the container main body, wherein the container comprises releasing means for releasing a gas in the container to outside the container, said releasing means being formed in said engaging portion.

3. A container according to claim 2, wherein said releasing means releases the gas in the toner accommodating container to outside the container when a pressure difference between an interior and exterior of the container exceeds a predetermined value.

4. A container according to claim 3, wherein said releasing means releases the gas in the toner accommodating container to outside the container when the pressure difference between the interior and exterior of the container exceeds 3.5 kPa.

5. A container according to claim 2, wherein said releasing means is a gas releasing groove formed by providing a surface of a member that constitutes the toner accommodating container with a plural and continued fine notches.

6. A container according to claim 3, wherein said releasing means is a gas releasing groove formed by providing a surface of a member that constitutes the toner accommodating container with a plural and continued fine notches.

7. A container according to claim 4, wherein said releasing means is a gas releasing groove formed by providing a surface of a member that constitutes the toner accommodating container with a plural and continued fine notches.

8. A container according to claim 5, wherein a width or depth of each of said notches that constitutes the gas releasing groove is larger than a particle size of toner particles to be accommodated in the toner accommodating container.

9. A container according to claim 6, wherein a width or depth of each of said notches that constitutes the gas releasing groove is larger than a particle size of toner particles to be accommodated in the toner accommodating container.

10. A container according to claim 7, wherein a width or depth of each of said notches that constitutes the gas releasing groove is larger than a particle size of toner particles to be accommodated in the toner accommodating container.

11. A container according to claim 8, wherein a depth of each of said notches that constitutes the gas releasing groove is in a range of 15 $\mu$m to 100 $\mu$m (both inclusive).

12. A container according to claim 9, wherein a depth of each of said notches that constitutes the gas releasing groove is in a range of 15 $\mu$m to 100 $\mu$m (both inclusive).

13. A container according to claim 10, wherein a depth of each of said notches that constitutes the gas releasing groove is in a range of 15 $\mu$m to 100 $\mu$m (both inclusive).

* * * * *